US005524426A

United States Patent [19]

Scaglia

[11] Patent Number: 5,524,426

[45] Date of Patent: Jun. 11, 1996

[54] SPINDLE-BEARING UNIT WITH AT LEAST TWO COAXIAL SPINDLES

[75] Inventor: Enzo Scaglia, Milan, Italy

[73] Assignee: SIRA SpA, Milan, Italy

[21] Appl. No.: 220,502

[22] Filed: Mar. 31, 1994

[30] Foreign Application Priority Data

Apr. 16, 1993 [IT] Italy ..... UD93A0064

[51] Int. Cl.[6] ..... D01H 13/00; D01H 1/10

[52] U.S. Cl. ..... 57/104; 57/1 R; 57/58.49; 57/100; 57/105; 57/132; 57/135

[58] Field of Search ..... 57/1 R, 58.3, 58.49, 57/92, 104, 105, 100, 313, 129, 130, 131, 132, 135, 75

[56] References Cited

U.S. PATENT DOCUMENTS

| | | | |
|---|---|---|---|
| 2,928,230 | 3/1960 | Stahlecker | 57/104 |
| 3,086,349 | 4/1963 | Keyser | 57/104 |
| 3,604,191 | 9/1971 | Jaeggli | 57/1 R |
| 3,641,757 | 2/1972 | Rehn | 57/1 R |
| 3,645,083 | 2/1972 | Lohring et al. | 57/100 |
| 4,330,987 | 5/1982 | Schippers et al. | 57/104 |
| 4,332,129 | 6/1982 | Schipper et al. | 57/1 R |
| 4,420,926 | 12/1983 | Remontet | 57/100 |
| 5,016,434 | 5/1991 | Kamp | 57/313 |

FOREIGN PATENT DOCUMENTS

| | | | |
|---|---|---|---|
| 2428851 | 6/1974 | Germany . | |
| 40-510612 | 4/1993 | Japan | 57/58.3 |
| 2053986 | 2/1991 | United Kingdom | 57/105 |

*Primary Examiner*—William Stryjewski
*Attorney, Agent, or Firm*—Antonelli, Terry, Stout & Kraus

[57] ABSTRACT

Unit to bear spindles which is suitable for spinning machines, twisters and also for two-for-one twisters and comprises a support (11) including two opposite sides (13*a*–13*b*), each of which bears at least one main bearing (30) coaxial with an opposite main bearing (30), the axis of these bearings (30) being substantially at a right angle to the opposite sides (13*a*–13*b*), each bearing (30) holding a shaft (19) which bears an interposed pulley (20*a*) and protrudes from the respective opposite sides (13*a*–13*b*), each shaft (19) supporting a respective spindle (16), the support (11) being equipped with an at least partly removable lateral plate (12) and constituting a spindle-bearing frame (10).

11 Claims, 3 Drawing Sheets

SPINDLE-BEARING UNIT WITH AT LEAST TWO COAXIAL SPINDLES

BACKGROUND OF THE INVENTION

This invention concerns a unit to bear coaxial spindles: The unit to bear coaxial spindles according to this invention is applied advantageously to the textile industry and especially to spinning machines, twisters and two-for-one twisters.

Spindles on textile machines of the state of the art have a rotary shaft and are borne on bolsters with roller bearings or ball bearings.

The spindles are fitted above the spindle-bearing frames and are rotated at a speed of about 15,000 r.p.m. or more. The spindles are generally rotated by a belt which runs in the air.

There may be the situation of a plurality of spindles installed on the same spindle-bearing frame and cooperating with the same belt driven by one single motor or the situation of a shaft bearing a plurality of pulleys, each of which actuates a belt that actuates a spindle.

The spindle-bearing systems of the state of the art entail the problem of being unable to ensure that at least two spindles rotate at the same speed, for this same speed of rotation is necessary to achieve an excellent doubling of two yarns, for instance.

In fact, the spindles nowadays either are set in rotation individually by different motors or are driven by the same motor, to which they are connected by a belt, but neither of these two methods ensures a good synchronized rotation of two spindles.

Moreover, with the spindle-bearing systems of the state of the art the spindles are arranged on only one side, generally the upper side, of the machine, and this situation involves a great overall bulk of the machine owing to the great number of spindles fitted to a machine.

Furthermore, the spindle-bearing systems of the state of the art entail the drawback that owing to the high speed of rotation of the spindles the transmission belt vibrates in the air and generates unpleasant vibrations and noises.

These vibrations and noises are greater when one belt drives a plurality of spindles.

So as to obviate this noise, proposals have been made that the transmission belt should be eliminated and that each spindle should be driven by a high-frequency motor positioned also on the same axis as the spindle.

This system, however, increases the cost of the machine considerably and makes it uncompetitive on the market precisely owing to the necessity, determined by the state of the art, of having to use a high-frequency motor so as to be able to bring the spindles to the desired speed.

SUMMARY OF THE INVENTION

The present applicants have designed, tested and embodied this invention to overcome the shortcomings of the state of the art and to achieve further advantages.

The purpose of the invention is to provide a unit to bear spindles which is suitable to hold two coaxial spindles.

This unit can be fitted to spinning machines, twisters and two-for-one twisters.

The unit according to the invention enables the spindles to be driven two by two and a perfectly synchronized rotation of at least one pair of spindles to be ensured.

A secondary purpose of the invention is to eliminate the problems of vibration and noise generated by the high speed of rotation of the spindles and by the linear speed of the belt.

The unit to bear coaxial spindles according to the invention enables the spindles to be fitted coaxially, two by two, on the two opposite, upper and lower, sides of the spindle-bearing frame.

In the unit to bear coaxial spindles according to the invention the plurality of rotary shafts cooperates with a tangential drawing belt, which transmits to the shafts the rotary motion needed for the winding of the yarn.

According to a variant each rotary shaft bearing coaxially a pair of spindles is individually powered so as to form a complete, independent assembly consisting of a motor and of a unit to bear coaxial spindles.

The unit to bear coaxial spindles according to the invention is positioned advantageously on a frame having a closed box-like structure, within which there runs the transmission belt that sets the coaxial spindles in rotation.

The spindles on the spindle-bearing frame are fitted in relation to the two opposite faces by employing two opposed holders, each of which holds a bearing.

A pulley is installed on the shaft of the spindle between the two holders and is rotated by a drawing belt.

According to a variant the spindle-bearing frame includes double spindle holders and lodges two substantially coaxial but separate spindles, for instance for the operations of doubling the yarns. In this case each spindle receives its rotary motion from its own transmission belt.

The transmission belts gets their motion either from one single motor or from two separate motors.

According to another variant, where old machines are being modernized, the invention arranges that there is generally a tangential belt to perform the drawing operation, as was the case previously, the purpose being to simplify and make more economical the modernizing work.

According to a further variant the spindles may be bored axially to enable an elastomeric yarn or another similar yarn to pass through and be wound in a spiral about the yarn being processed.

According to the invention one side of the spindle-bearing frame can be dismantled to facilitate entry to the inside.

According to the invention the spindle-bearing frame can be further soundproofed by applying or spraying within it a sound-deadening material.

According to a variant each spindle can be driven individually by a normal two-pole, four-pole or multi-pole electric motor governed by an actuator inverter for adjustment of the speed.

This is made possible by acting on the ratios between the pulley positioned coaxial with, and firmly secured to, the spindle and the pulley located on the shaft of the motor.

The invention, by providing opposed spindles, enables the machine to be better balanced and also makes possible two differentiated take-up packages.

It is also possible to carry out the doubling of two yarns coming from two coaxial opposed spindles rotating in perfect synchronization; the result of such doubling is excellent inasmuch as the two spindles are coaxial and firmly connected together and therefore rotate at the same speed.

The doubling can be carried out in the same way with three or four yarns coming from different spindles.

According to the invention, where the tubes are vertical, the falling of the tube fitted to the lower side is prevented by using tubes with a known system of axial attachment.

The falling of the coils of yarn into the lower tube is obviated, instead, by employing a coil-retaining device which is applied axially about the spindle and cooperates with the outer surface of the spindle so as to prevent the outermost coils becoming unwound by themselves.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 2:
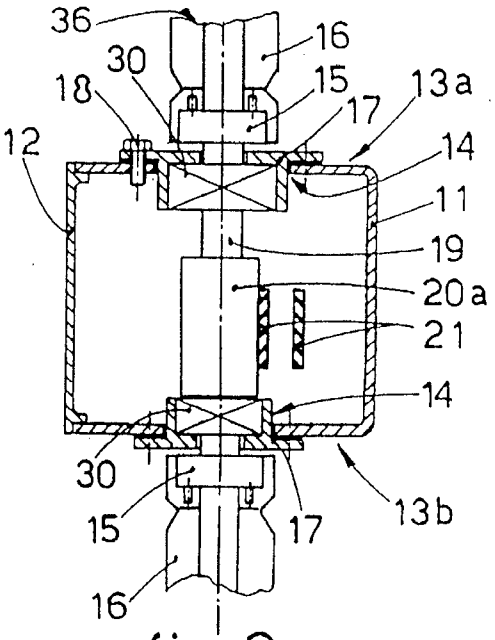
FIG. 2 shows a cross-section of the spindle-bearing frame along the line A—A of FIG. 1.
Figure 1:
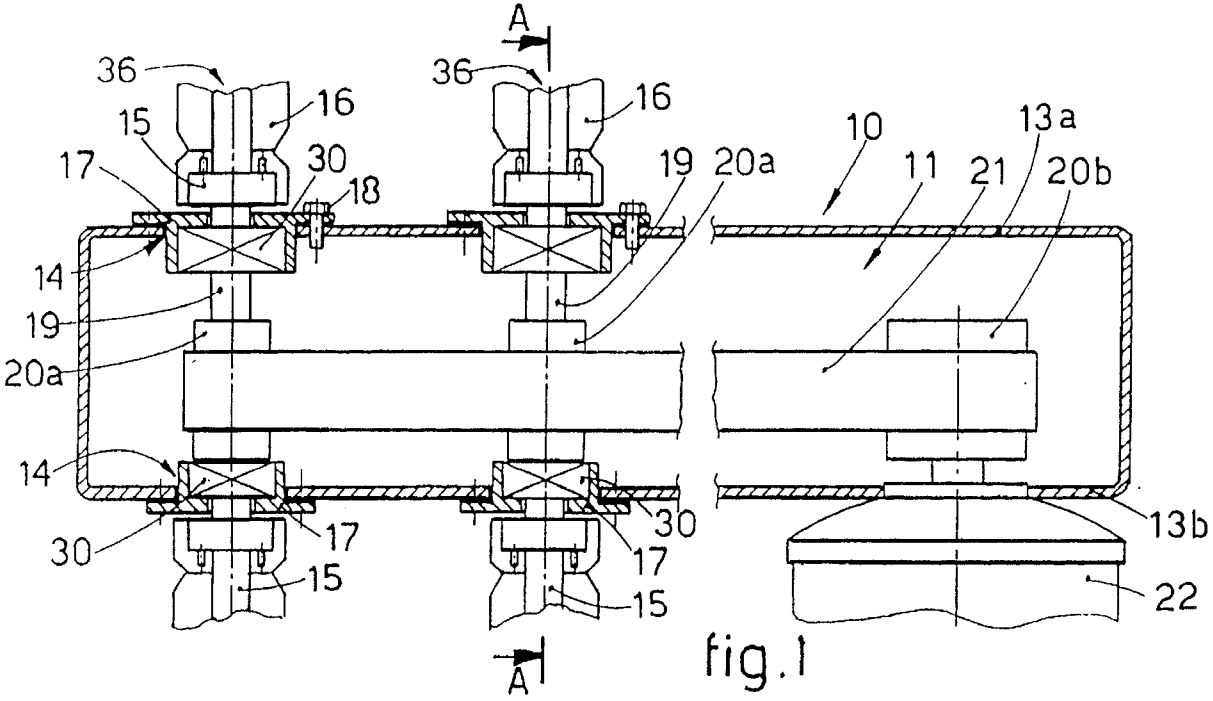
FIG. 1 shows a lengthwise section of a spindle-bearing frame according to the invention.

The reference number 10 in the attached figures denotes generally a spindle-bearing frame to which is fitted a plurality of units 36 bearing coaxial spindles according to the invention.

The spindle-bearing frame 10 according to the invention comprises in this case a metallic support 11 with a U-shaped section closed by a lateral plate 12 so as to form a closed box-shaped structure.

A plurality of equidistant holes 14 in which holders 15 bearing the spindles 16 are fitted is included on the upper 13*a* and lower 13*b* sides of the U-shaped metallic support 11.

On each of the holders 15 of the spindles 16 is installed a bearing 30 secured to the spindle-bearing frame 10 by a flange 17, which holds a bearing 30 and is secured by screws 18 in this case.

In this case a rotary shaft 19, in the middle of which a first pulley 20*a* is installed coaxially and solidly, passes through the holders 15 of the spindles 16.

A tangential drawing belt 21 cooperates with the first pulley 20*a*, runs within the spindle-bearing frame 10 and is driven in turn by a second pulley 20*b* solidly fixed coaxially to a drive shaft of a motor 22.

Figure 3:
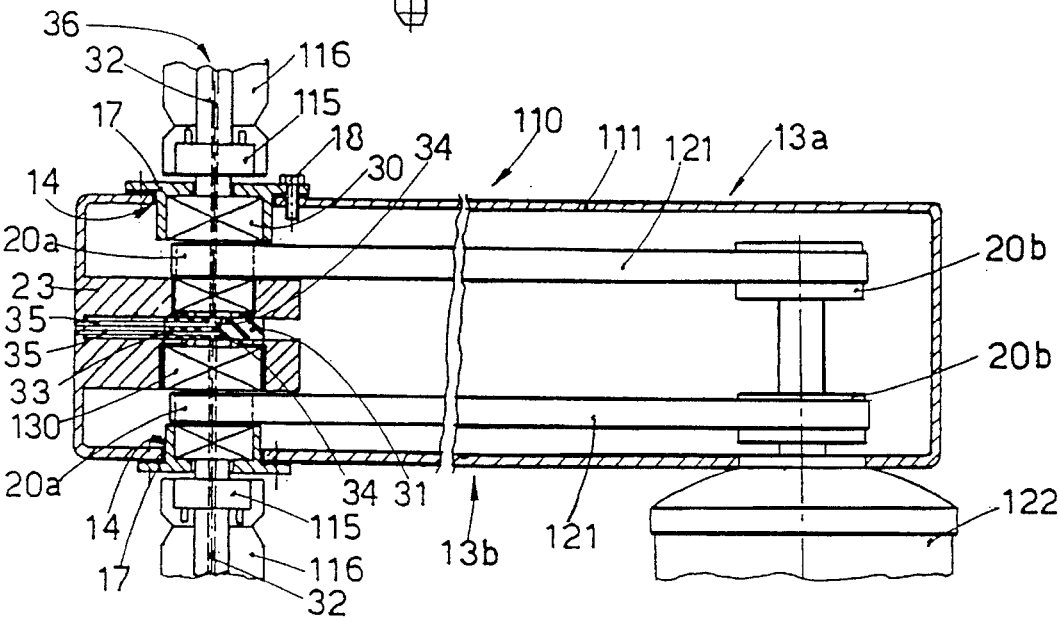
FIG. 3 shows a lengthwise section of a variant of the spindle-bearing frame according to the invention.

According to a variant (FIG. 3) two intermediate plates 23 separated by a spacer 31 are included in the U-shaped metallic support 111 of the spindle-bearing frame 110; each of these intermediate plates 23 holds a further bearing 130 coinciding with the holes 14.

In this way each holder 115 of the spindles 116 is installed on two bearings 30-130; two transmission belts 122 are included and are driven by one and the same motor 122.

In this case each spindle 116 is hollow and each spindle holder 115 contains an axial bore consisting of an inner first conduit 32 that passes axially through the spindle 116 and the holder 115.

The spacer 31 includes on each face in contact with the intermediate plates 23 a radial second conduit 33 joined at one side to an axial third conduit 34 and extending in a fourth conduit 35.

With the embodiment of this variant the invention enables the yarn to be covered by means of a elastomeric yarn or the like.

According to another variant soundproofing material is applied to the inner side of the U-shaped support 11 so as to soundproof the spindle-bearing frame 10 additionally.

Figure 4:
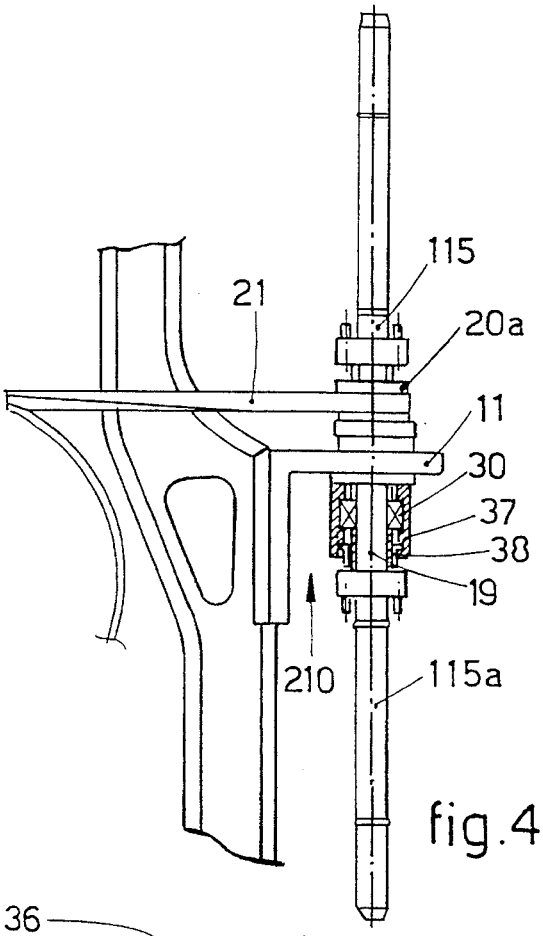
FIG. 4 shows a further type of embodiment according to the invention.

The embodiment shown in FIG. 4 is used where a conventional machine is being modernized, and comprises a common spindle-bearing plate 210 with a support 11 to which the holders 115 of the spindles are generally applied by being screwed.

The drawing of the rotary shaft 19, to which are applied the two holders 115 coaxial with and opposite to the support 11, is generally carried out by a tangential belt 21, which runs in air, by means of an interposed pulley 20*a*.

In this case a conventional spindle-bearing plate 210 is equipped with a second lower holder 115*a* of a spindle by applying to the rotary shaft 19 a bolster 37 with a relative flange 38, to which the holder 115*a* of the spindle is screwed. The bolster 37 bears a roller bearing or ball bearing 130.

Figure 5:
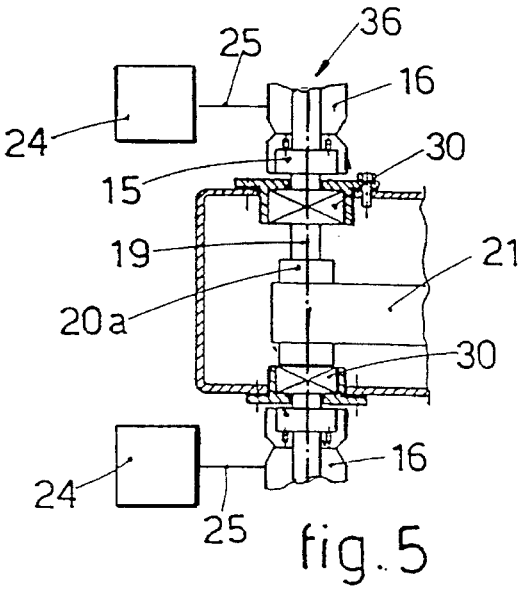

This embodiment simplifies greatly the work to modernize conventional spindle plates 210 and makes them suitable to bear spindle-bearing units, each of which holds two coaxial spindles By means of the spindle-bearing frame 10 according to the invention (FIG. 5) it is possible to obtain two differentiated take-up packages 24 at the same time, each package coming from a different spindle 16.

Figure 7:
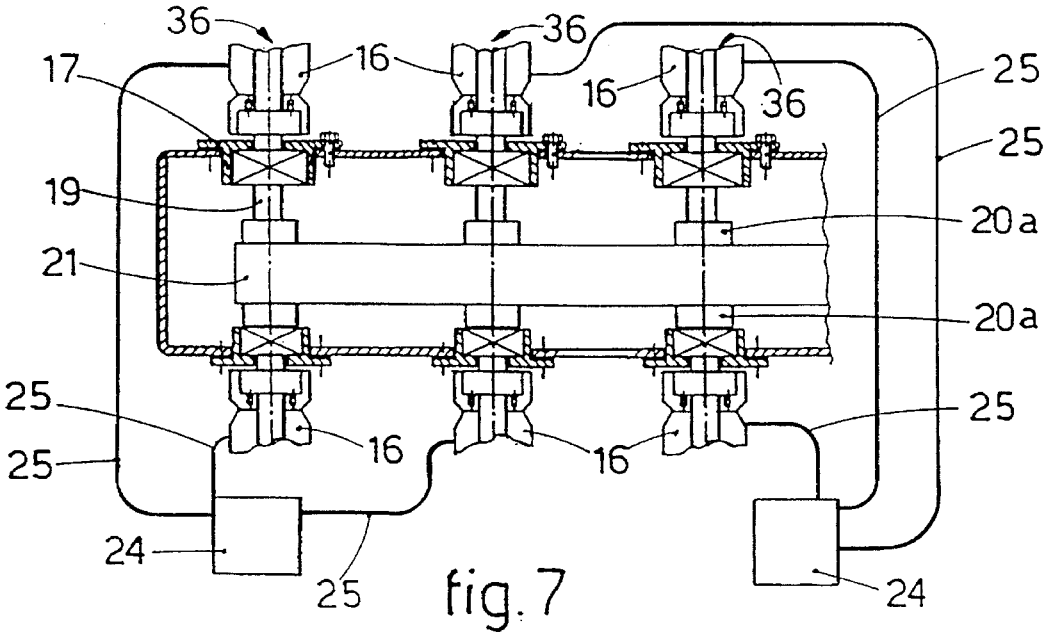
FIGS. 5 to 7 show some diagrams of the doubling of a plurality of yarns coming from spindles fitted to a spindle-bearing frame according to the invention.
Figure 6:
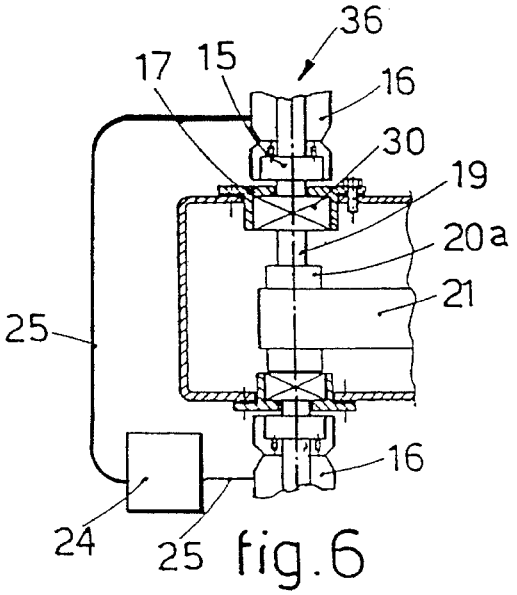

With the spindle-bearing frame 10 according to the invention it is possible to carry out twisting of two yarns 25 coming from two spindles 16 installed on the same rotary shaft 19 (FIG. 6) or even the twisting of three or more yarns 25 (FIG. 7).

The problem of the falling of the spindle 16 fitted to the lower side in the spindle-bearing frame 10 according to the invention is overcome by using tubes with an axial attachment of a known type.

Figure 10:
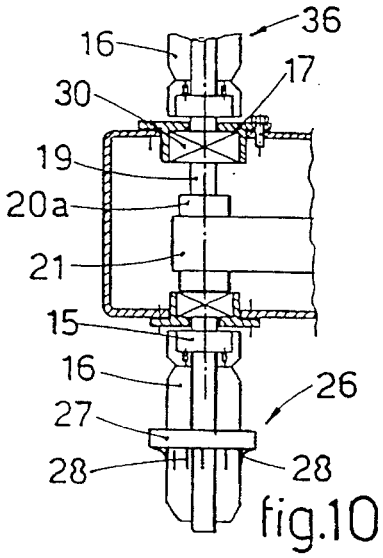
FIG. 10 is a front view of a spindle to which is fitted a coil-retaining device of the type of FIG. 8.

Instead, the problem of the falling of coils of yarn is overcome by using an appropriate coil-retaining device 26, which is applied axially around the spindle 16 and cooperates with the outer surface thereof, thus preventing the outermost coils unwinding by themselves (FIG. 10).

Figure 8:
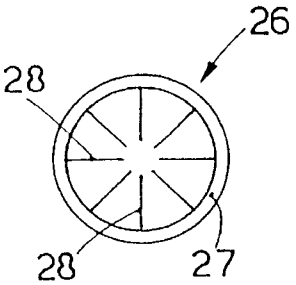

In the example of FIG. 8 the coil-retaining device 26 comprises an outer plastic ring 27 bearing a plurality of foldable threads 28 arranged radially within the ring 27. When the coil-retaining device 26 has been applied axially to the spindle 16, the foldable threads 28 cooperate with the outer surface of the spindle 16 and bend, thus retaining the outermost coils resiliently.

Figure 9:
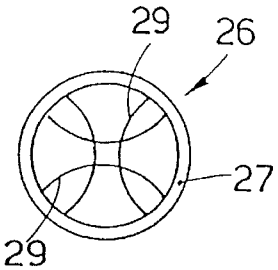
FIGS. 8 and 9 show a plan view of two different types of a coil-retaining device.

In the form of embodiment of FIG. 9 the radial foldable threads 28 have been replaced by a plurality of plastic threads 29 connected at their two ends to the plastic ring 27 so as to define between them a space for the axial passage of the spindle 16.

In the spindle-bearing frame 10 according to the invention the units 36 to bear spindles can be powered one by one by using a plurality of two-pole or multi-pole motors and by installing an inverter to adjust their speed. This is possible inasmuch as the pulleys can be dimensioned as desired.

I claim:

1. Unit to bear spindles, comprising:

a spindle bearing frame which comprises a support including two opposite sides and an at least partly removable lateral plate;

a pair of opposing coaxial main bearings, each of which is secured to each of the two opposite sides, the axis of the main bearings being substantially at a right angle to the two sides;

a shaft which is coaxial with and held by the pair of main bearings and protrudes from the respective opposite sides, the shaft supporting a respective spindle at each opposing end; and a pulley provided on the shaft interposed between the pair of opposing coaxial main bearings.

2. Unit as in claim 1, in which each unit to bear spindles is set in rotation by its own two-pole or multi-pole electric motor with an inverter and gearing-up pulley.

3. Unit as in claim 1, in which a plurality of spindle-bearing units are set in rotation by a tangential belt running within the support, the support being a U-shaped metallic support.

4. Unit as in claim 1, in which each of the pair of main bearings is positioned by a flange that bears the bearing, each flange being positioned on each of said two opposite sides of said support.

5. Unit as in claim 1, in which a coil-retaining device cooperates with at least one of the spindles for preventing outermost coils wound around the spindle from unwinding by themselves.

6. Unit to bear spindles, comprising:

a spindle bearing frame which comprises a support including two opposite sides and intermediate plates provided parallel to and between the two opposite sides;

a pair of opposing coaxial first main bearings, each of which is secured to each of the two opposite sides;

at least two second bearings secured to the intermediate plates and coaxial with the pair of first main bearings and distanced apart, the common axis of the first main bearings and second bearings being substantially at a right angle to the opposite sides;

two coaxial opposed shafts, each of which is coaxial with and held by a first main bearing and a second bearing, the two shafts protruding from the respective opposite sides and supporting respective spindles; and two pulleys, each of which is provided on each of the two shafts between the respective first main bearing and second bearing.

7. Unit as in claim 6, in which each unit to bear spindles is set in rotation by its own two-pole or multi-pole electric motor with an inverter and gearing-up pulley.

8. Unit as in claim 6, in which a plurality of spindle-bearing units is set in rotation by a tangential belt running within the support, the support being a U-shaped metallic support.

9. Unit as in claim 6, in which each first main bearing is positioned on each of the two opposite sides by a flange that bears the bearing.

10. Unit as in claim 6, in which a coil-retaining device cooperates with at least one of the spindles for preventing outermost coils wound around the spindle from unwinding by themselves.

11. Unit to bear spindles, comprising:

a spindle bearing frame which comprises a support including two Opposite sides and intermediate plates provided parallel to and between the two opposite sides;

a pair of opposing coaxial first main bearings, each of which is secured to each of the two opposite sides;

at least two second bearings secured to the intermediate plates and coaxial with the pair of first main bearings and distanced apart, the common axis of the first main bearings and second bearings being substantially at a right angle to the opposite sides;

two coaxial opposed shafts, each of which is coaxial with and held by a first main bearing and a second bearing, the two shafts protruding from the respective opposite sides and supporting respective spindles, in which each shaft is axially bored with an inner first conduit and cooperates with a respective radial second conduit located between the two second bearings, each shaft bearing a spindle; and two pulleys, each of which is provided on each of the two shafts between the respective first main bearing and second bearing.

* * * * *